US011982024B2

(12) United States Patent
Nemeth

(10) Patent No.: US 11,982,024 B2
(45) Date of Patent: May 14, 2024

(54) CHARCOAL-INFUSED TOWEL

(71) Applicant: Christopher Nemeth, Miami, FL (US)

(72) Inventor: Christopher Nemeth, Miami, FL (US)

( * ) Notice: Subject to any disclaimer, the term of this patent is extended or adjusted under 35 U.S.C. 154(b) by 286 days.

(21) Appl. No.: 16/384,009

(22) Filed: Apr. 15, 2019

(65) Prior Publication Data

US 2020/0208306 A1 Jul. 2, 2020

Related U.S. Application Data

(60) Provisional application No. 62/785,309, filed on Dec. 27, 2018.

(51) Int. Cl.

| | |
|---|---|
| ***D02G 3/04*** | (2006.01) |
| ***D01F 1/10*** | (2006.01) |
| ***D01F 2/10*** | (2006.01) |
| ***D01F 8/02*** | (2006.01) |
| ***D01F 8/18*** | (2006.01) |
| ***D03D 1/00*** | (2006.01) |
| ***D03D 15/292*** | (2021.01) |
| ***D03D 15/47*** | (2021.01) |

(52) U.S. Cl.

CPC ..... *D02G 3/042* (2013.01); *D01F 1/10* (2013.01); *D01F 2/10* (2013.01); *D01F 8/02* (2013.01); *D01F 8/18* (2013.01); *D02G 3/04* (2013.01); *D03D 1/0017* (2013.01); *D03D 15/292* (2021.01); *D03D 15/47* (2021.01); *D10B 2101/12* (2013.01); *D10B 2201/02* (2013.01); *D10B 2201/22* (2013.01); *D10B 2509/026* (2013.01)

(58) Field of Classification Search

CPC . D02G 3/04; D01F 1/10; D03D 15/47; D10B 2101/12; D10B 2201/02; D10B 2201/22

See application file for complete search history.

(56) References Cited

U.S. PATENT DOCUMENTS

| | | | | |
|---|---|---|---|---|
| 7,810,308 | B2 * | 10/2010 | Wang | A23B 4/08 57/283 |
| 2009/0317584 | A1 * | 12/2009 | Ivanoff | D04B 1/02 428/95 |
| 2016/0037977 | A1 | 2/2016 | Hozumi | |
| 2016/0102422 | A1 | 4/2016 | Hozumi | |
| 2016/0201233 | A1 | 7/2016 | Hozumi | |
| 2016/0206026 | A1 * | 7/2016 | Hozumi | D02G 3/26 |
| 2016/0208420 | A1 | 7/2016 | Hozumi | |
| 2016/0281276 | A1 | 9/2016 | Hozumi | |
| 2016/0289870 | A1 | 10/2016 | Hozumi et al. | |

(Continued)

OTHER PUBLICATIONS

Temkho "The Hygienic Towel Infused With Charcoal" from Kickstarter.com. https://www.kickstarter.com/projects/1169717678/a-towel-imbued-with-charcoal-by-temkho/description (Year: 2017).*

(Continued)

*Primary Examiner* — Lynda Salvatore

(74) *Attorney, Agent, or Firm* — Roberto M. Suarez

(57) ABSTRACT

A charcoal-infused towel product is woven from a combination of charcoal-infused yarn fibers and cotton yarn fibers. The charcoal-infused yarn fibers are made by combining a liquefied activated charcoal paste with a liquefied cellulose paste to produce filaments of textile fiber embedded with activated charcoal.

3 Claims, 6 Drawing Sheets

(56) References Cited

U.S. PATENT DOCUMENTS

2017/0321354 A1 11/2017 Hozumi

OTHER PUBLICATIONS

Dunee "Difference Between Charcoal and Activated Charcoal" https://www.differencebetween.com/difference-between-charcoal-and-vs-activated-charcoal/#:~:text=Activated%20charcoal%20is%20made%20from,is%20charcoal%20treated%20with%20oxygen. (Year: 2012).*

Mogahzy "Ch 9—Structure and Types of Yarn for Textile Product Design" Engineering Textiles: Integrating the Design and Manufacture of Textile Products. Woodhead Publishing. pp. 240-270. 2009. (Year: 2009).*

Celanese Acetate LLC. Complete Textile Glossary—S. (Year: 2001).*

On-line advertisement—"Kishu Binchtan Towels—Black" by Uchino.

Webpage, "Binchotan Charcoal Body Scrub Towel" by Morihata International Ltd. Col.

* cited by examiner

CHARCOAL-INFUSED TOWEL

CROSS-REFERENCE TO RELATED APPLICATIONS

This application is a non-provisional of, and claims priority to, U.S. Provisional Patent Application No. 62/785,309, filed on Dec. 27, 2018; which application is incorporated herein in its entirety.

FIELD OF THE INVENTION

The invention disclosed broadly relates to the field of towels, and more particularly relates to towels made with super thin extra-long strand yarn with added, or infused, charcoal.

BACKGROUND OF THE INVENTION

Activated charcoal is known to have many beneficial uses and has been promoted as a potent natural treatment. Used in many applications from teeth whitening to water filtration, activated charcoal's negatively charged, porous texture helps to attract and trap toxins, oils, and bacteria. Activated charcoal has gained popularity in products for the cleaning and healthy maintenance of the face and skin. For example, activated charcoal face mask creams, face wash lotions, and soaps have been introduced to the market. These products are applied to the skin topically and as part of a person's hygiene regimen. Other examples of activated charcoal products include: charcoal air fresheners, socks, eye covers, toothbrushes, and toothpaste.

Even if, for example, a person is anticipating the health benefits of using a charcoal infused face wash, when they go to dry their face with a regular towel they may be adding harmful bacteria back onto their face.

Also, not everyone has easy access all of the time to a clean water source for a face washing regimen. For example, while exercising it would be beneficial to have the health benefits of activated charcoal while the activity is being performed. At times such as this, a charcoal infused towel would be beneficial, as the activated charcoal would contact the skin, drawing away harmful oils and toxins, while also gently exfoliating.

Currently there are no products in the market that provide the health benefits of activated charcoal that is infused and embedded into a towel. None of these current solutions in the marketplace can travel with the consumer to be used during activities and/or used to both wash and dry the skin and face.

Other solutions attempting to solve this need in the art include the use of silver infused yarns and/or copper infused yarns. The claimed benefits of these products include odor reduction (as in the case of the silver infused yarn) to healing and pain relief (from the copper infused yarn). While these health benefits have not been widely substantiated, fears of allergic reactions to the silver and copper are enough to discourage their use in a towel, in particular a face towel.

Currently, there is no towel product that is soft and gentle enough for the face, yet provides the health benefits of activated charcoal. Therefore, there is a need for a towel that is manufactured from a yarn infused with activated charcoal, that is also soft and absorbent, which aims to overcome the above-stated shortcomings of the known art.

SUMMARY OF THE INVENTION

Briefly, a charcoal-infused towel product is woven from a combination of charcoal-infused yarn fibers and cotton yarn fibers. The charcoal-infused yarn fibers are made by combining a liquefied activated charcoal paste with a liquefied cellulose paste to produce filaments of textile fiber embedded with activated charcoal.

A method for making a charcoal-infused towel product includes steps of: combining a liquefied activated charcoal paste with a liquefied cellulose paste to produce a cellulose-charcoal paste; generating filaments of textile fiber from the cellulose-charcoal paste; spinning the filaments with cotton fibers, producing a cotton-cellulose-charcoal yarn; and weaving the cotton-cellulose-charcoal yarn with cotton yarn to produce a towel product.

BRIEF DESCRIPTION OF THE DRAWINGS

In the accompanying figures, like reference numerals refer to identical or functionally similar elements throughout the separate views. The accompanying figures, together with the detailed description below are incorporated in and form part of the specification and serve to further illustrate various embodiments and to explain various principles and advantages all in accordance with the present invention, in which.

DETAILED DESCRIPTION

Figure 1:
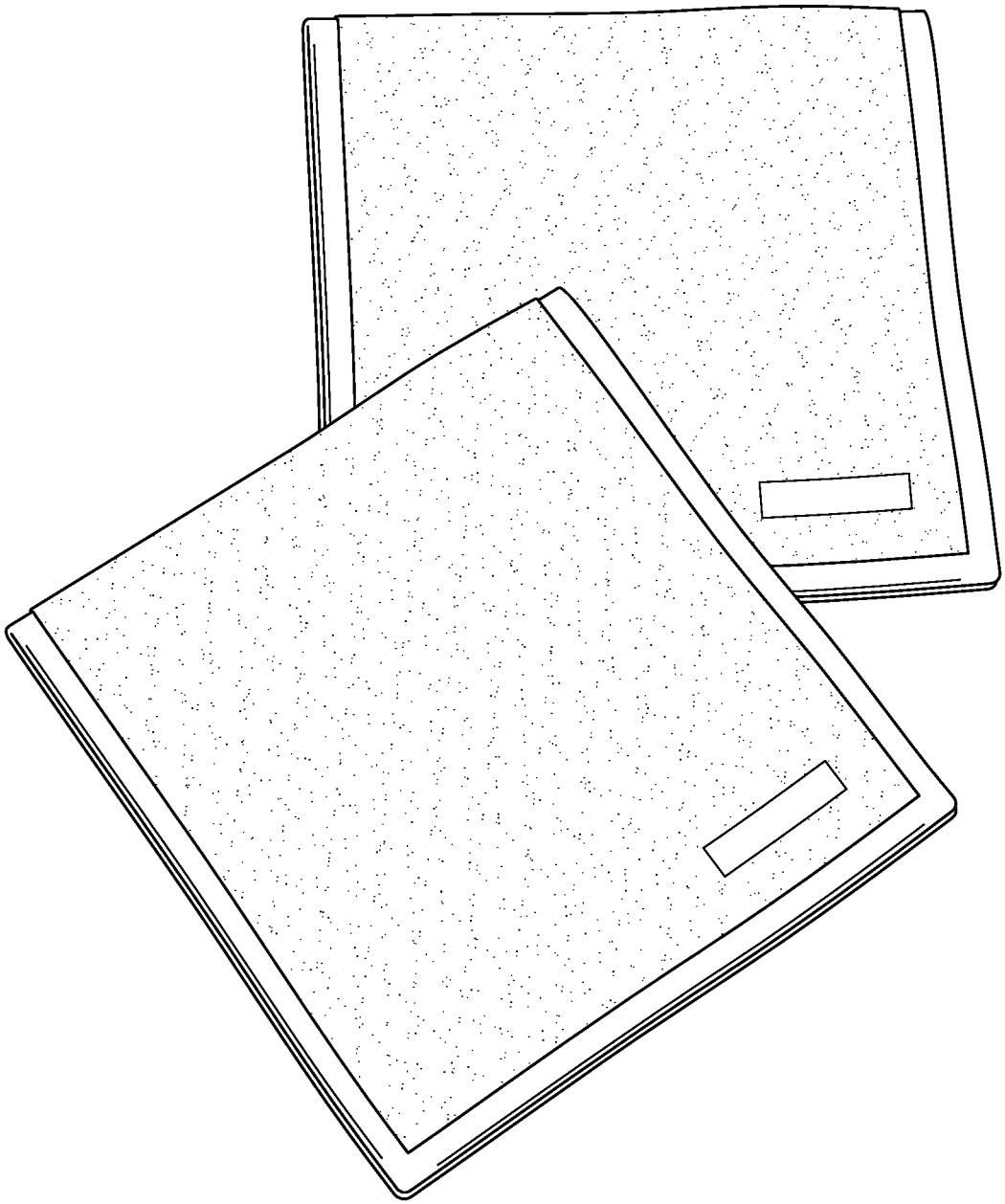
FIG. 1 shows an example of a light charcoal towel, according to an embodiment.

In the Description below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, structures, steps, etc. are optionally present. For example, an article "comprising" (or "which comprises") components A, B, and C can consist of (i.e., contain only) components A, B, and C, or can contain not only components A, B, and C, but also one or more other components or structures.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40% means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm.

Any element in a claim that does not explicitly state "means for" performing a specified function, or "step for" performing a specific function, is not to be interpreted as a "means" or "step" clause as specified in 35 U.S.C. § 112, ¶ 6. In particular, the use of "step of" in the claims herein is not intended to invoke the provisions of 35 U.S.C. § 112, ¶ 6.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein. Specifically, component names, types, and values, as depicted in the exemplary schematic diagrams, are not intended to limit the scope of the present invention and are presented only as possible embodiments.

In this specification and in the appended drawings, words and phrases have the meanings commonly attributed to them in the relevant art except as otherwise specified herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

While the invention is disclosed herein in the context of face towels, it is within the scope of the invention disclosed that the towel product and associated method for making a charcoal-infused towel product may also be used in other contexts, such as, but not limited to, other fabric-based applications where the superior softness and robust absorbency provided by "super-thin" cotton together with the detoxification and cleaning power of activated charcoal are desired.

The size of yarn (yarn count) is defined by its weight and fineness. Yarn count is measured by the number of grams per one kilometer of yarn, or the "Tex." In the spinning industry, the English Cotton Count ("Ne") is used as a unit of measure. This is the number of yarn hanks (840 yards long) per pound of yarn. The larger the number, the finer the yarn. For example, the yarn count for denim ranges from Ne 4.0 to Ne 12.5. The towel disclosed herein combines the superior softness and robust absorbency provided by "super-thin" cotton fiber with an Ne of 30+, together with the detoxification and cleaning power of charcoal to make a unique towel. "Super-thin" cotton fiber as used herein is a descriptive term for yarn that has the following attributes: a cotton count (Ne) above 30, long strand (more than 1⅛ inch long; and no twist/zero twist. The charcoal-infused towel can be used during regular activities at the gym or yoga studio as well as at home for your daily face cleaning routine.

The infusion of the activated charcoal imparts anti-odor and anti-bacterial properties onto the towel itself. Activated charcoal is known to reduce bacteria growth and therefore reduces bacteria growth on the surface of the towel, thus reducing the creation of odor-causing bacteria on the towel. In addition to reducing the possibility of bacteria growth on the towel itself, the activated charcoal helps to detoxify and clean the skin and face by absorbing excess oil and debris. The porous texture of the charcoal helps to pull oil, dirt and grime out of the skin pores in a way that the non-charcoal infused towels cannot. The beneficial effect of the invention disclosed herein includes the reduction of poisons, chemicals, dirt and other micro-particles from building up on the skin.

Additionally, the infusion of the charcoal into the long fibers of the towel has an exfoliation effect by lightly scraping off dead cells from the surface of the skin. Beneficially, activated charcoal is not metabolized nor absorbed by the body, but it can be used to treat some poisonous bites and disinfect some wounds.

The beneficial effects of the charcoal can be re-activated by exposing the towel/charcoal yarn to high temperature (heat). Thus, the charcoal infused into the yarn is re-activated by washing the towel/charcoal yarn in hot water and/or drying the towel/charcoal yarn in hot air. Note: the re-activation will equally happen whether the towel is only washed, only dried, or washed and dried using heat. Thus, after every washing of the towel, the charcoal is re-activated and the towel is ready to detoxify and clean the skin and face. Also, since the charcoal is infused into the yarn, it will remain inside the yarn permanently.

Figure 6:
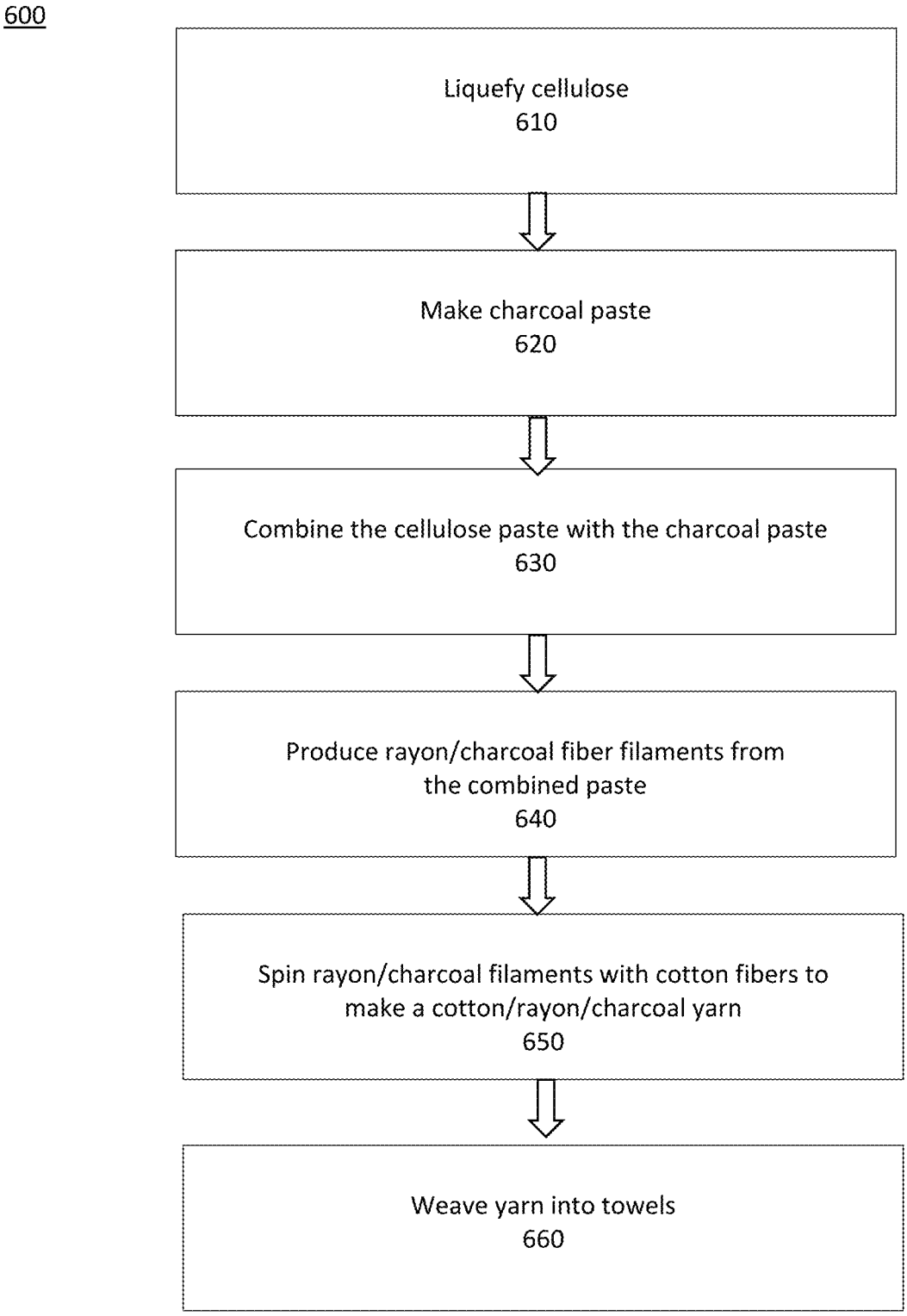
FIG. 6 is a process flow diagram of a method for making a charcoal-infused towel, according to an embodiment.

In view of the foregoing, a preferred embodiment of the present invention is directed to a towel product manufactured using a combination cotton plus charcoal/rayon yarn in varying proportions. Referring now to the drawings in general, and to FIG. 6 in particular, there is shown a process flow diagram 600 of a method for making a charcoal-infused towel, according to an embodiment.

In step 610, a base substance such as cellulose is liquefied using, for example, a chemical bath. Rayon, specifically, a textile fiber made from regenerated cellulose, is known in the art and is made by liquefying cellulose (such as wood pulp) and then forcing it through, for example, a spinneret to produce filaments which are chemically solidified, resulting in fibers of nearly pure cellulose. In step 620, activated charcoal is liquefied in a chemical bath and then combined with the liquefied cellulose in step 630. In one embodiment, the proportion of charcoal to cellulose in the combined substance is in the range of 1% to 10% charcoal to 90%-99% cellulose.

The chemical bath process is known. The chemical bath is made of a mixture of h2so4 (vitriol), znso4 (zinc sulfate) and na2so4 sodium sulfate. These chemicals are mixed together at different proportions to basically melt the burnt tree (charcoal) pulp into a paste. The liquefied cellulose paste is also created using a separate liquid bath with the same mixture of chemicals listed above.

The charcoal liquid paste is mixed together with the cellulose liquid paste by, for example, adding the charcoal liquid paste through a flowing pipe into another pipe with the flowing cellulose liquid paste. The contents of the chemical bath are re-balanced back to an original state after each use and the contents are re-used over and over again in what is called a closed-loop. In step 640, the cellulose/charcoal liquid is then forced through the spinneret, producing filaments where the charcoal does not merely adhere on top of the rayon, but is mixed in and embedded into the rayon. In this way, the activated charcoal is integral to the textile fiber.

In step 650 the resulting rayon/charcoal fiber is then spun together with cotton fibers, yielding a cotton/rayon/charcoal yarn. The proportion of rayon/charcoal fibers to cotton fibers is varied in order to create yarns of varying "strength"—or potency—of charcoal. Additionally, the thickness of the cotton fiber is varied in order to provide varying degrees of "softness." Thinner cotton fibers tend to yield a softer towel. In step 660 the cotton/rayon/charcoal yarn is then woven to produce a towel.

A preferred embodiment combines the rayon/charcoal fibers together with "super thin" cotton fibers to create a "super thin" extra-long staple cotton/rayon/charcoal yarn referred to as "super thin" charcoal yarn. This yarn is approximately 60-70% "super thin" cotton and 30-40% rayon/charcoal.

FIGS. 1 through 5 illustrate towels with varying degrees of charcoal strength, or potency, in different designs. These can include, for example, light, medium, and heavy charcoal. Some of the possible combinations include:

A Light Charcoal towel product is shown in FIG. 1. The towels shown in FIG. 1 are made from Design Formula #1, which is a mix of the following yarn fibers, woven in a "stripe" pattern:

one strand thick cotton yarn;

one strand of "super thin" cotton charcoal-infused yarn (65% cellulose-charcoal textile fiber to 35% cotton fiber); and one strand of thick and thin bamboo shape cotton yarn.

Figure 2:
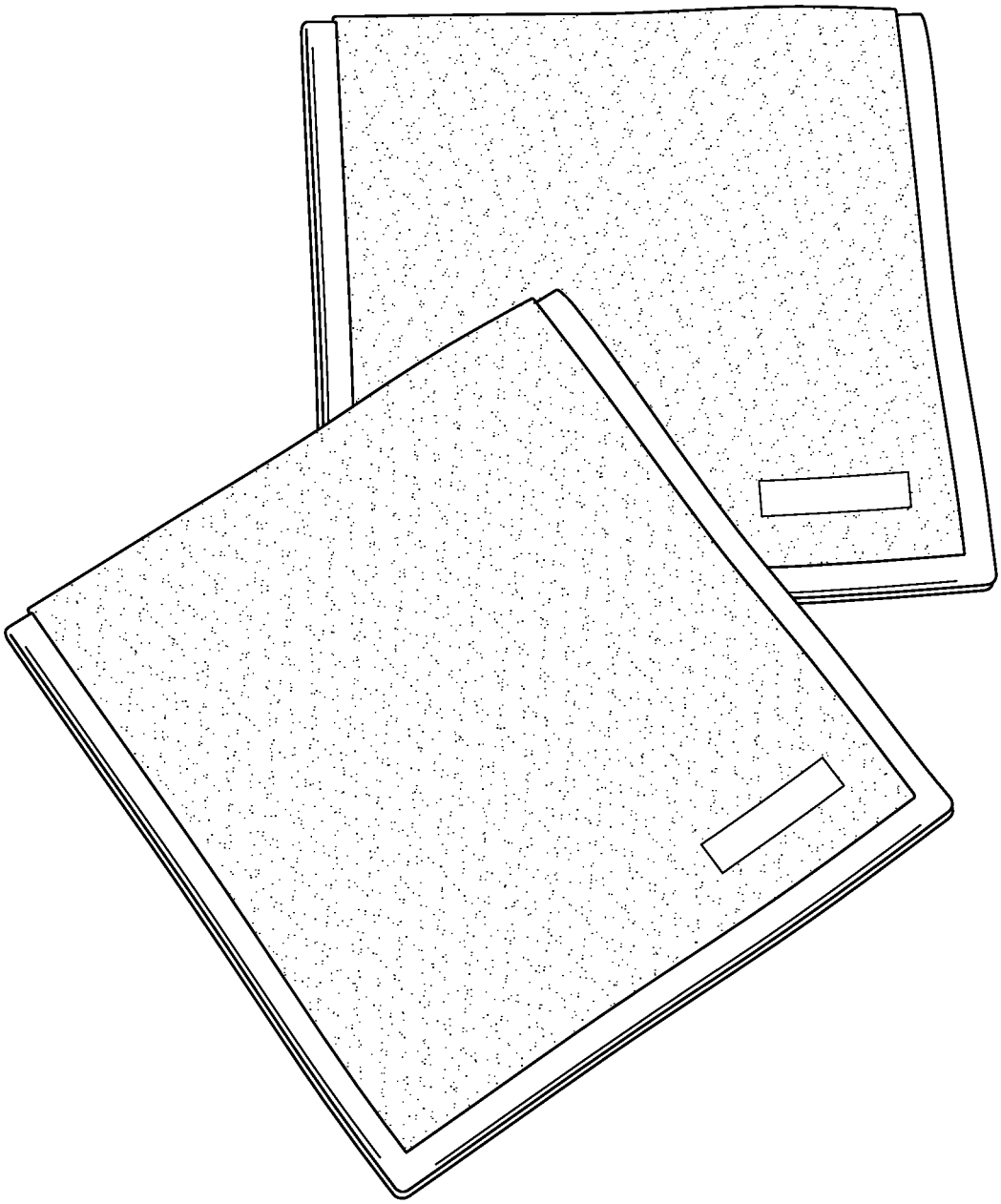
FIG. 2 shows an example of a light charcoal towel, according to another embodiment.

Another Light Charcoal towel product is shown in FIG. 2. The towel shown in FIG. 2 is made from Design Formula #2, which is a mix of the following yarn fibers, woven in a "circle" pattern:

one strand of thick cotton yarn;

one strand of "super thin" cotton charcoal-infused yarn (65% cellulose-charcoal textile fiber to 35% cotton fiber); and one strand of thick and thin bamboo shape cotton yarn.

Figure 3:
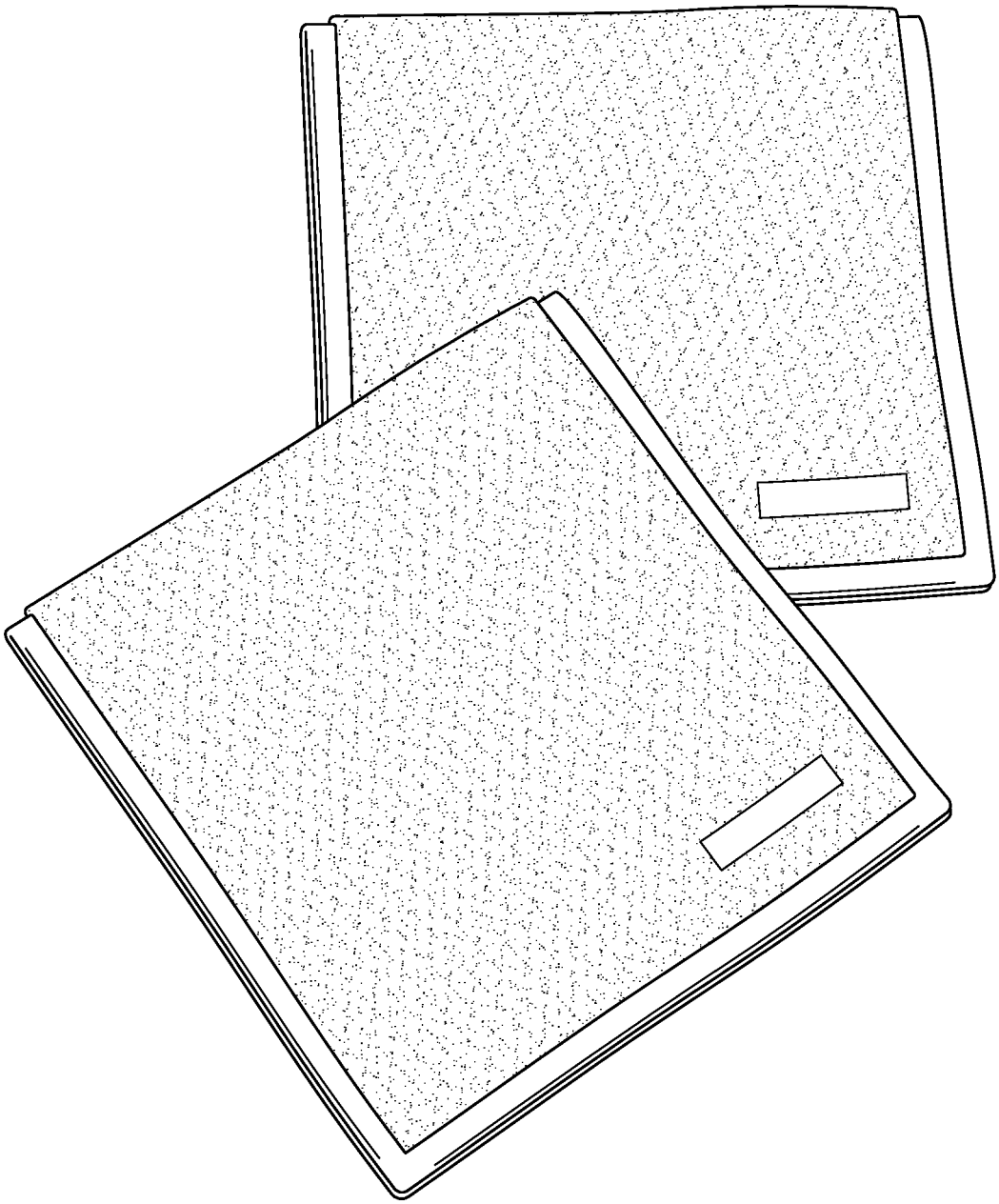
FIG. 3 shows an example of a medium charcoal towel, according to an embodiment.

A Medium Charcoal towel product is shown in FIG. 3. The towel shown in FIG. 3 is made from Design Formula #3, which is a mix of the following yarn fibers, woven in a "long strand" pattern:

one strand thick cotton yarn; and one strand of "super thin" cotton charcoal-infused yarn (65% cellulose-charcoal textile fiber to 35% cotton fiber).

Figure 4:
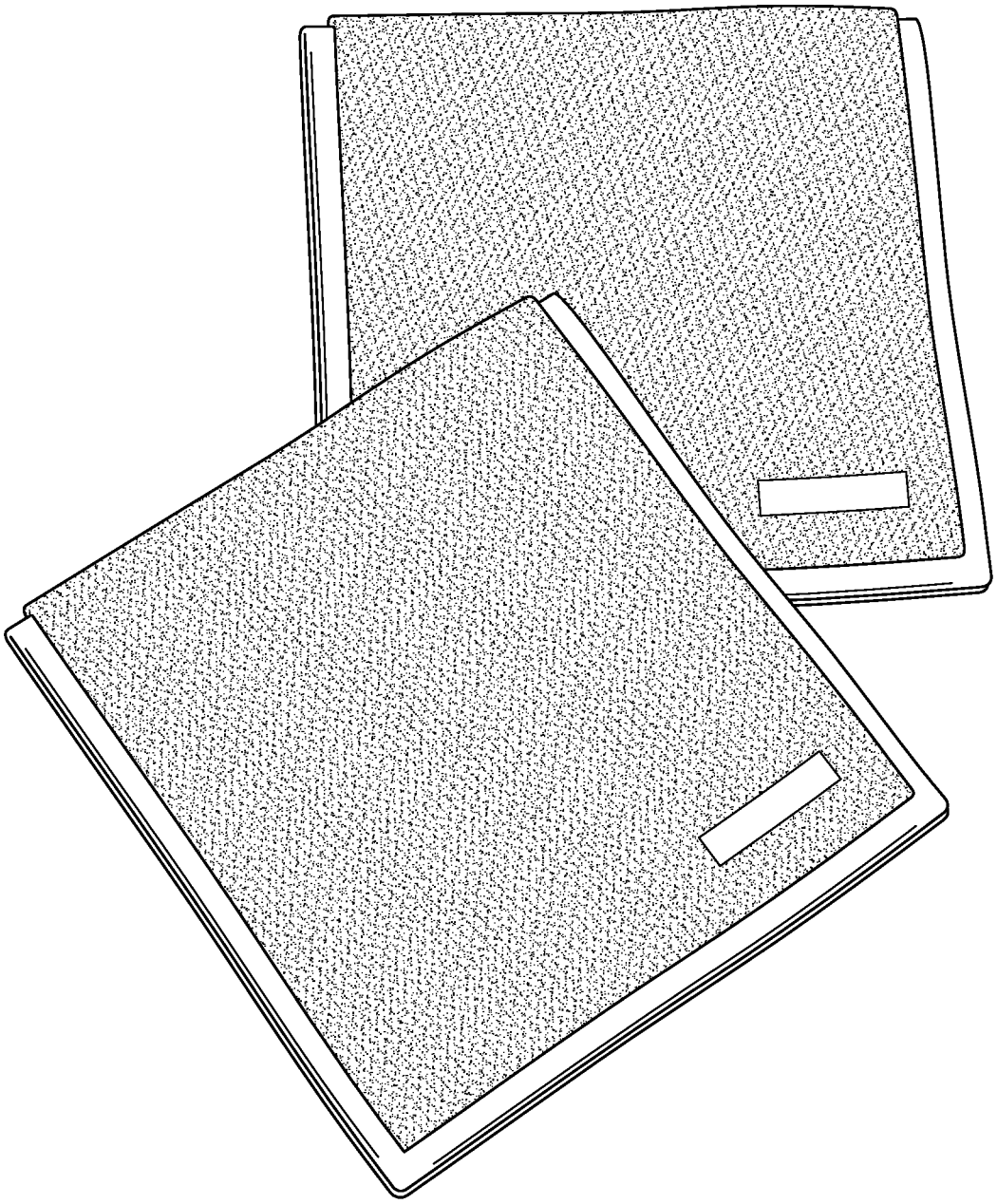
FIG. 4 shows an example of a heavy charcoal towel, according to an embodiment.

A Heavy Charcoal towel product is shown in FIG. 4. The towel shown in FIG. 4 is made from Design Formula #4, which is a mix of the following yarn fibers, woven in a "long strand" pattern:

one strand of "super thin" cotton yarn; and two strands of "super thin" cotton charcoal-infused yarn, (65% cellulose-charcoal textile fiber to 35% cotton fiber).

Figure 5:
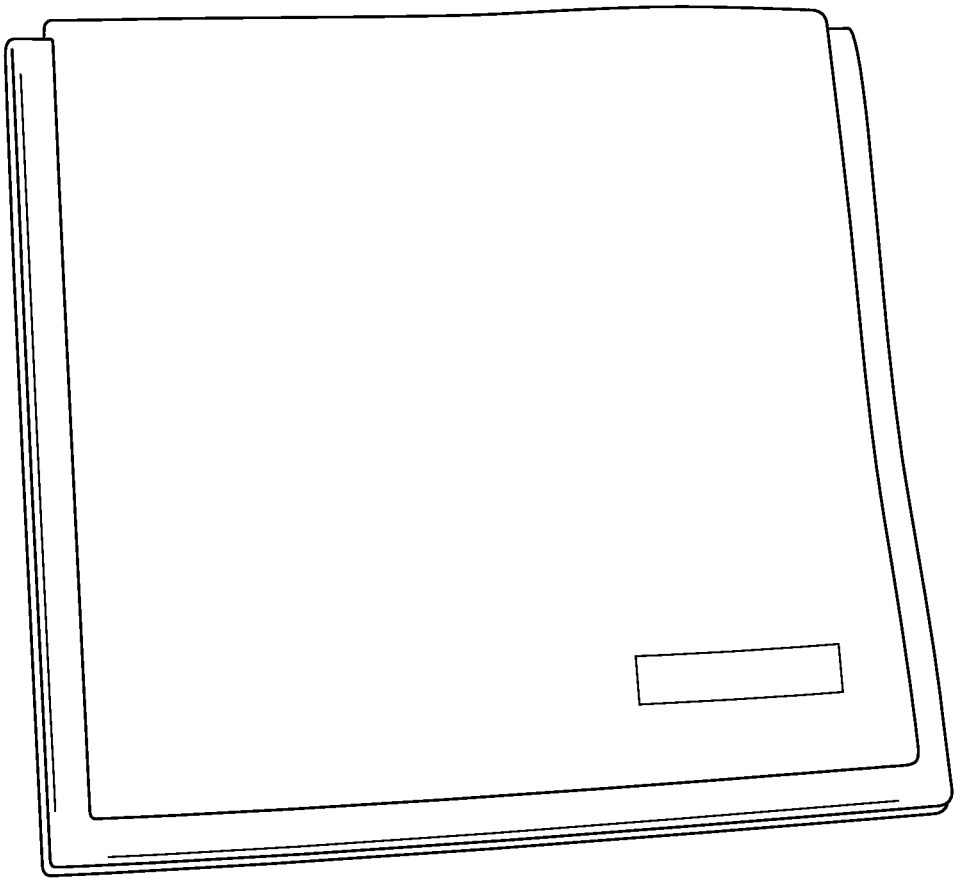
FIG. 5 shows an example of an extra-strength charcoal towel, according to an embodiment.

An Extra-Strength Charcoal towel product is shown in FIG. 5. The towel shown in FIG. 5 is made from Design Formula #5, which is a mix of the following yarn fibers, woven in a "long strand" pattern:

two strands of "super thin" cotton charcoal-infused yarn, (65% cellulose-charcoal textile fiber to 35% cotton fiber).

While the invention as claimed can be modified into alternative forms, specific embodiments thereof are disclosed herein by way of example. It should be understood, however, that the foregoing disclosure not intended to limit the invention to the particular form disclosed, but on the contrary, the intention is to cover all modifications, equivalents and alternatives falling within the scope of the present disclosure.

Further, in view of many embodiments to which the principles of the invention may be applied, it should be understood that the illustrated embodiments are exemplary embodiments and should not limit the present disclosure.

Therefore, while there has been described what is presently considered to be the preferred embodiment, it will be understood by those skilled in the art that other modifications can be made within the spirit of the disclosure. The above description(s) of embodiment(s) is not intended to be exhaustive or limiting in scope. The embodiment(s), as described, were chosen in order to explain the principles of the invention, show its practical application, and enable those with ordinary skill in the art to understand how to make and use the invention. It should be understood that the invention is not limited to the embodiment(s) described above, but rather should be interpreted within the full meaning and scope of the disclosure.

The invention claimed is:

1. A charcoal-infused towel product, the charcoal-infused towel product comprising:

a cotton-cellulose-charcoal yarn comprising cotton fibers and cellulose-charcoal filaments, the cellulose-charcoal filaments comprising liquefied activated charcoal paste and liquefied cellulose paste, wherein the activated charcoal is integral to the resultant cellulose-charcoal filaments, where the cotton fibers have an Ne above 30, are long-strand, and no twist/zero twist; and a cotton yarn;

wherein the cotton-cellulose-charcoal yarn and the cotton yarn woven together in a given pattern provides the superior softness and the robust absorbency provided by cotton together with the detoxification and cleaning power of activated charcoal.

2. The charcoal-infused towel product of claim 1 wherein the cotton yarn further comprises super thin cotton fibers having an Ne above 30, are long-strand, and no twist/zero twist.

3. The charcoal-infused towel product of claim 2 wherein the proportion of cellulose-charcoal filaments to cotton fibers is 65 percent cellulose-charcoal filaments to 35 percent cotton fibers.

* * * * *